US008752578B2

(12) United States Patent
Mincher et al.

(10) Patent No.: US 8,752,578 B2
(45) Date of Patent: Jun. 17, 2014

(54) REGULATOR

(75) Inventors: Adrian Mincher, West Yorkshire (GB); Daniel Copley, Oxford, MS (US)

(73) Assignee: Parker Hannifin Manufacturing (UK) Ltd., Hemel Hempstead, Hertfordshire (GB)

( * ) Notice: Subject to any disclaimer, the term of this patent is extended or adjusted under 35 U.S.C. 154(b) by 0 days.

(21) Appl. No.: 13/468,505

(22) Filed: May 10, 2012

(65) Prior Publication Data

US 2012/0255529 A1 Oct. 11, 2012

Related U.S. Application Data

(63) Continuation of application No. PCT/GB2010/051906, filed on Nov. 16, 2010.

(30) Foreign Application Priority Data

Dec. 10, 2009 (GB) ..... 0921576.5

(51) Int. Cl.
*F16K 31/12* (2006.01)
*F01M 13/00* (2006.01)

(52) U.S. Cl.
USPC ..... 137/509; 123/572; 123/573; 123/574; 123/41.86; 137/510; 251/61.2; 251/61.3; 251/61.4

(58) Field of Classification Search
USPC ..... 123/572, 573, 41.86; 137/509, 510
See application file for complete search history.

(56) References Cited

U.S. PATENT DOCUMENTS

| | | | | | |
|---|---|---|---|---|---|
| 3,308,798 | A | * | 3/1967 | Snider | 123/572 |
| 3,380,441 | A | * | 4/1968 | Lewis | 123/572 |
| 3,469,565 | A | * | 9/1969 | Albright et al. | 123/574 |
| 3,678,910 | A | | 7/1972 | Marlett | |
| 4,245,592 | A | | 1/1981 | Atkins, Sr. | |
| 4,483,508 | A | * | 11/1984 | Marsh et al. | 251/61.3 |
| 4,557,226 | A | * | 12/1985 | Mayer et al. | 123/41.86 |
| 5,564,401 | A | | 10/1996 | Dickson | |
| 5,904,177 | A | * | 5/1999 | Mullin et al. | 137/503 |

(Continued)

FOREIGN PATENT DOCUMENTS

| | | | |
|---|---|---|---|
| DE | 200 16 214 | U1 | 2/2002 |
| DE | 202004 013123 | U1 | 1/2006 |
| DE | 10 2007 012483 | A1 | 9/2008 |
| GB | 1 032 511 | | 6/1966 |

OTHER PUBLICATIONS

Search Report under Section 17(5) dated Mar. 26, 2010 from the Intellectual Property Office in corresponding Great Britain Application No. 0921576.5.

(Continued)

*Primary Examiner* — Lindsay Low
*Assistant Examiner* — Tea Holbrook
(74) *Attorney, Agent, or Firm* — Christopher Hunter

(57) ABSTRACT

A regulator (108) comprising a first chamber (132), and second chamber (134) and an actuator (130). The second chamber (134) is coupled to the first chamber (132) through an aperture (156). The actuator (130) is arranged to the adjust the size of the aperture (156) according to a pressure differential between fluid pressure in the first chamber (132) and a pressure reference (36). The rate of change of the cross sectional area of the aperture (156) is arranged to have a non-linear response to a change in the pressure differential.

15 Claims, 4 Drawing Sheets

(56) References Cited

U.S. PATENT DOCUMENTS

| | | | | |
|---|---|---|---|---|
| 6,553,979 | B2 * | 4/2003 | Albright | 123/574 |
| 6,651,636 | B1 * | 11/2003 | Albright | 123/574 |
| 6,810,667 | B2 * | 11/2004 | Jung et al. | 60/611 |
| 7,025,049 | B2 * | 4/2006 | Pietschner | 123/572 |
| 7,238,216 | B2 | 7/2007 | Malgorn et al. | |
| 7,473,291 | B2 | 1/2009 | Evenstad et al. | |
| 7,607,289 | B2 * | 10/2009 | Schmeichel et al. | 60/283 |
| 7,878,479 | B2 * | 2/2011 | Yamamoto | 251/61.4 |
| 8,104,740 | B2 * | 1/2012 | Igarashi | 251/61.2 |
| 2005/0061305 | A1 * | 3/2005 | Pietschner | 123/572 |
| 2006/0219966 | A1 * | 10/2006 | Zecchi et al. | 251/61.2 |
| 2008/0142091 | A1 * | 6/2008 | Meinig et al. | 137/488 |

OTHER PUBLICATIONS

Notification of Transmittal of The International Search Report and The Written Opinion of The International Searching Authority dated Mar. 15, 2011 In corresponding International Application No. PCT/GB2010/051906.

Notification of Transmittal of The International Report on Patentability dated Apr. 23, 2012 in corresponding International Application No. PCT/GB2010/051906.

* cited by examiner

REGULATOR

CROSS REFERENCE TO RELATED APPLICATIONS

This application is a continuation of co-pending International Application No. PCT/GB2010/051906, filed Nov. 16, 2010, which designated the United States, the disclosure of which is incorporated herein by reference, and which claims priority to Great Britain Patent Application No. GB 0921576.5, filed Dec. 10, 2009.

BACKGROUND OF THE INVENTION

The present invention relates to a regulator. In particular, the present invention relates to a regulator for regulating the pressure within a crankcase ventilation system. In particular, the present invention provides a regulator suitable for use in a pumped crankcase ventilation system. In certain embodiments of the present invention, the regulator may be used in a crankcase ventilation system further incorporating a separator for separating particulate, liquid and aerosol contaminants from a blow-by gas stream within a reciprocating engine.

Blow-by gas within a reciprocating engine is generated as a by-product of the combustion process. During combustion, some of the mixture of gases escape past piston rings or other seals and enter the engine crankcase outside of the pistons. The term "blow-by" refers to the fact that the gas has blown past the piston seals. The flow level of blow-by gas is dependent upon several factors, for example the engine displacement, the effectiveness of the piston cylinder seals and the power output of the engine. Blow-by gas typically has the following components: oil (as both a liquid and an aerosol, with aerosol droplets in the range 0.1 μm to 10 μm), soot particles, nitrous oxides (NOx), hydrocarbons (both gaseous hydrocarbons and gaseous aldehydes), carbon monoxide, carbon dioxide, oxygen, water and other gaseous air components.

If blow-by gas is retained within a crankcase with no outlet the pressure within the crankcase rises until the pressure is relieved by leakage of crankcase oil elsewhere within the engine, for example at the crankcase seals, dipstick seals or turbocharger seals. Such a leak may result in damage to the engine.

In order to prevent such damage, and excessive loss of oil, it is known to provide an outlet valve which allows the blow-by gas to be vented to the atmosphere. However, with increasing environmental awareness generally, and within the motor industry in particular, it is becoming increasingly unacceptable to allow blow-by gas, which is inevitably contaminated with oil and other contaminants from within the crankcase, to simply be vented to atmosphere. Furthermore, such venting increases the speed at which crankcase oil is consumed.

Consequently, it is known to filter the blow-by gas. The filtered blow-by gas may then either be vented to the atmosphere as before (in an open loop system), or it may be returned to an air inlet of the engine (in a closed loop system). The filtering may be performed by passing the blow-by gas through a filtering medium, or another known form of gas contaminant separator. For a closed loop system, filtration is required in order to remove oil, soot and other contaminants to protect engine components from fouling and any resultant reduction in performance or failure of a component.

The conventional arrangement of an engine blow-by gas/oil separator returning cleaned gas to an engine air intake is commonly referred to as a Closed Crankcase Ventilation system (CCV). This system requires the use of a crankcase pressure regulator in order to ensure that an excessive proportion of the vacuum generated by the engine air intake is not translated via the CCV separator to the engine crankcase.

Referring now to FIG. 1, this illustrates the arrangement of a conventional CCV system 2 coupled to a diesel engine 4. Blow-by gas from the engine crankcase passes to the CCV system 2 along inlet duct 6. The CCV system 2 comprises a regulator 8 coupled to the inlet duct 6 and a contaminant separator 10 in series. The regulator 8 and separator 10 are not visible in FIG. 1, however FIG. 2 is a flow chart schematically illustrating the arrangement of the components of the CCV system.

A pump 12 may optionally be provided within the CCV system to increase the pressure drop across the separator 10, thereby increasing the filtering efficiency. Cleaned blow-by gas exits the CCV system through gas outlet 14 and is returned to the engine air intake system. Specifically, the engine air intake system draws in air from outside of the vehicle through an inlet 16, the air then passing through an inlet air filter and silencer 18, a compressor 20 driven by a turbo charger 22 (in turn driven by the engine exhaust 24) and an after cooler 26 to cool the compressed air before it is supplied to the engine 4. The cleaned blow-by gas passes from the gas outlet 14 to the compressor 20. Oil and other contaminants separated from the blow-by gas are returned to the engine crankcase through oil drain 28.

In the system of FIGS. 1 and 2 a portion of the vacuum generated between the turbocharger 22 and the air filter 18 is lost over the blow-by separator 10. Any remaining vacuum otherwise exposed to the engine crankcase is controlled by the regulator 8. It can be seen that the total air flow drawn by the turbo compressor 22 is not necessarily restricted by the closing of the regulator, since the difference can be drawn via the engine air filter 18.

A conventional regulator 8 known for use in a CCV system is illustrated in FIG. 3. The regulator 8 comprises a floating diaphragm 30 which is arranged to open or close to restrict blow-by gas flow and pressure as required. Blow-by gas enters a first regulator chamber 32 through the CCV gas inlet 6. The diaphragm 30 at least partially occludes the gap between the first chamber 32 and a second chamber 34 (in turn coupled to the separator 10). A first side of diaphragm 30 is exposed to the blow-by gas in chamber 32. A second side of the diaphragm 30 is exposed to an ambient gas pressure within a chamber 36, which has an opening to the ambient environment. Alternatively, the third chamber may be coupled to a different pressure reference.

Movement of the diaphragm 30 is controlled by first and second springs 38, 40. Spring 38 is positioned within the second chamber and resists movement of the diaphragm 30 to close the gap between the first and second chambers 32, 34. Spring 40 is positioned within the third chamber 36 and resists movement of the diaphragm 30 to open the gap between the first and second chambers 32, 34. Adjustment of the response of springs 38, 40 and adjustment of the relative sizes of the first and second sides of the diaphragm 30 acted upon by the blow-by gas and the ambient gas pressure can be used to control the rate and extent of movement of the diaphragm 30.

The application of an integral pump 12 to improve the separation performance of a CCV system 2 is relatively new. The pressure in the first chamber 32 is regulated to the desired crankcase pressure by specification of the pump to generate the required vacuum and specifying appropriate pressure regulation spring forces. The pressure in the second chamber 34 is defined by the differential pressure loss across the separator and the vacuum generated by the integral pump 12. The vacuum generated is determined according to the operating point along the chosen pump's flow versus pressure performance curve.

It will be appreciated that for a pumped CCV separator system the flow through the pump can be entirely restricted by the position of the regulating diaphragm. For the regulator illustrated in FIG. 3, if the diaphragm 30 comes into contact with the end of tubular wall 42 separating the first and second chambers 32, 34 then gas flow between the first and second chambers is interrupted. The effect upon the pump 12 is similar to the phenomena of pump surge in which an unregulated displacement pump can give rise to spikes in the output pressure. Restricted flow resulting from a closed regulator moves the pump operating point to a corresponding low flow and high vacuum position. The increased vacuum generated in the second chamber further increases the force acting on the vacuum regulation springs 38, 40 and flow of blow-by gas is restricted yet further. Only greater force acting upon the diaphragm 30 generated by a build up of positive pressure in the engine crankcase can open the regulator again. As discussed above, excessive pressure build up in a crankcase can result in damage to the crankcase and escape of oil. A closed loop control cycle of high and low pressure hunting results between the regulator and the pump which cannot be controlled with a conventional linear response regulator.

It will be further appreciated that the problems of high and low pressure hunting for pumped CCV systems may also be experienced within other forms of crankcase ventilation systems. Specifically, pressure hunting may occur in open crankcase ventilation systems, non-pumped closed crankcase ventilation systems and exhaust pumped ventilation systems. More generally, the problems discussed above associated with conventional regulators may occur in any system which includes a pressure regulator.

SUMMARY OF THE INVENTION

It is an object of embodiments of the present invention to obviate or mitigate one or more of the problems associated with the prior art, whether identified herein or elsewhere. In particular, it is an object of embodiments of the present invention to provide a regulator which resists the effects of pump surge and pressure hunting discussed above when the regulator is used within a pumped CCV system.

According to a first aspect of the present invention there is provided a regulator comprising: a first chamber; a second chamber coupled to the first chamber through an aperture; and an actuator arranged to the adjust the size of the aperture according to a pressure differential between fluid pressure in the first chamber and a pressure reference; wherein the rate of change of the cross sectional area of the aperture is arranged to have a non-linear response to a change in the pressure differential.

An advantage of the first aspect of the present invention is that because the rate of change of the cross sectional area of the aperture has a non-linear response to a change in the pressure differential, any desired control function can be generated. For instance, for a constant rate of change in the pressure differential, the rate of reduction of the cross sectional area of the aperture may accelerate.

The regulator may further comprise a housing containing the first and second chambers.

The actuator may comprise a diaphragm coupled to the housing and separating the first chamber from the pressure reference. The diaphragm may be arranged to move in response to a change in the differential pressure across the diaphragm.

The first and second chambers may be separated by a wall including a slot. The actuator may further comprise a barrier coupled to the diaphragm arranged to slide across the slot as the diaphragm moves. The aperture may be defined by the slot and the barrier. In particular, the first and second chambers may be separated by a tubular wall and the barrier may comprise a tubular structure coupled to the diaphragm and arranged to slide within or over the tubular wall to partially occlude the slot.

According to a second aspect of the present invention there is provided a crankcase ventilation system comprising: a gas inlet arranged to receive gas from a crankcase; a regulator according to any one of the preceding claims, wherein the first chamber is coupled to the first chamber, and a gas outlet coupled to the second chamber; wherein the gas outlet is arranged to be coupled to an engine air inlet system or to discharge gases to the ambient environment.

The crankcase ventilation system may further comprise a separator arranged to filter solid and liquid contaminants from gases passing between the gas inlet and the gas outlet.

The crankcase ventilation system may further comprise a pump coupled between the regulator and the gas outlet and arranged to generate a vacuum thereby increasing the pressure differential across the regulator.

BRIEF DESCRIPTION OF THE DRAWINGS

An embodiment of the present invention will now be described, by way of example only, with reference to the accompanying drawings, in which.

DETAILED DESCRIPTION OF THE PREFERRED EMBODIMENT

Figure 1:
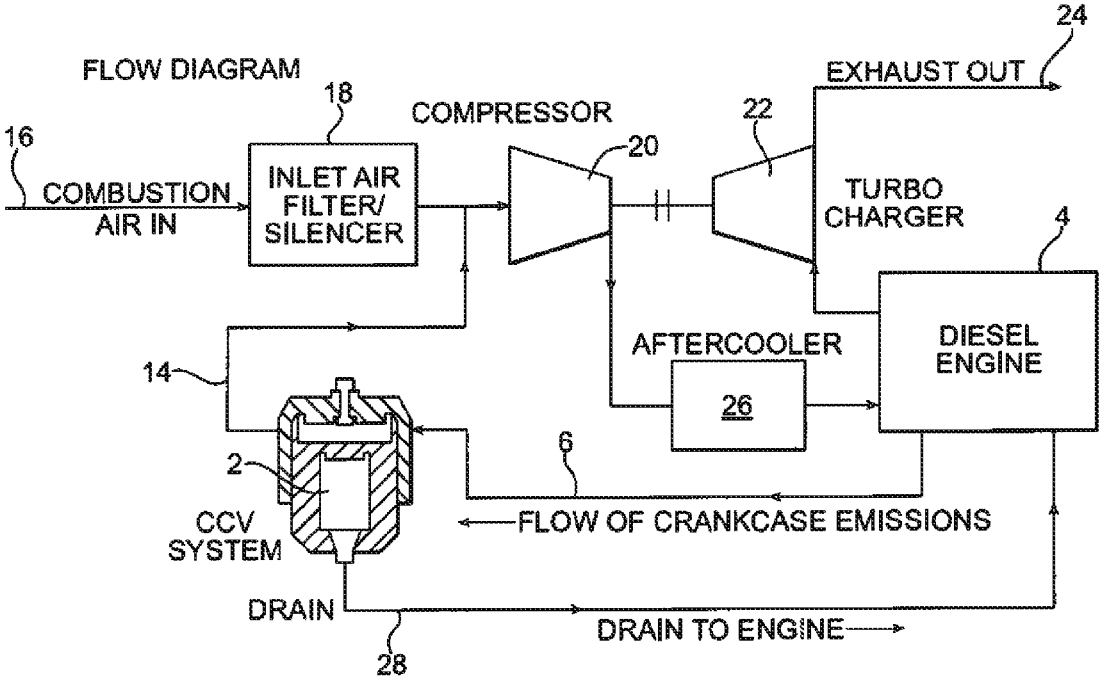
FIG. 1 schematically illustrates an engine system including a closed crankcase ventilation system.
Figure 2:
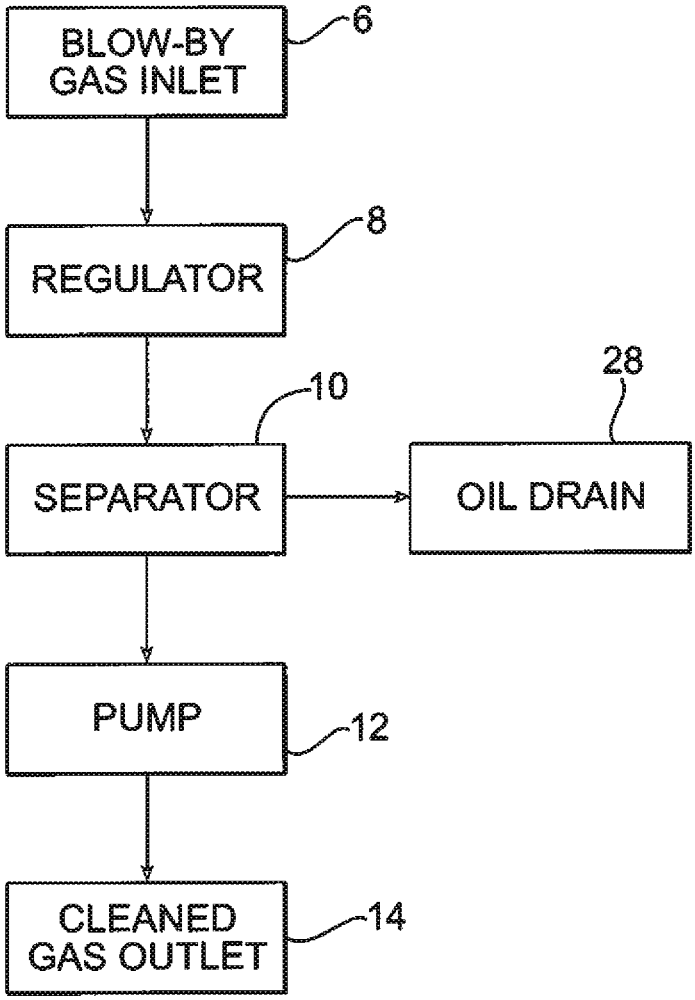
FIG. 2 schematically illustrates a CCV system.
Figure 3:
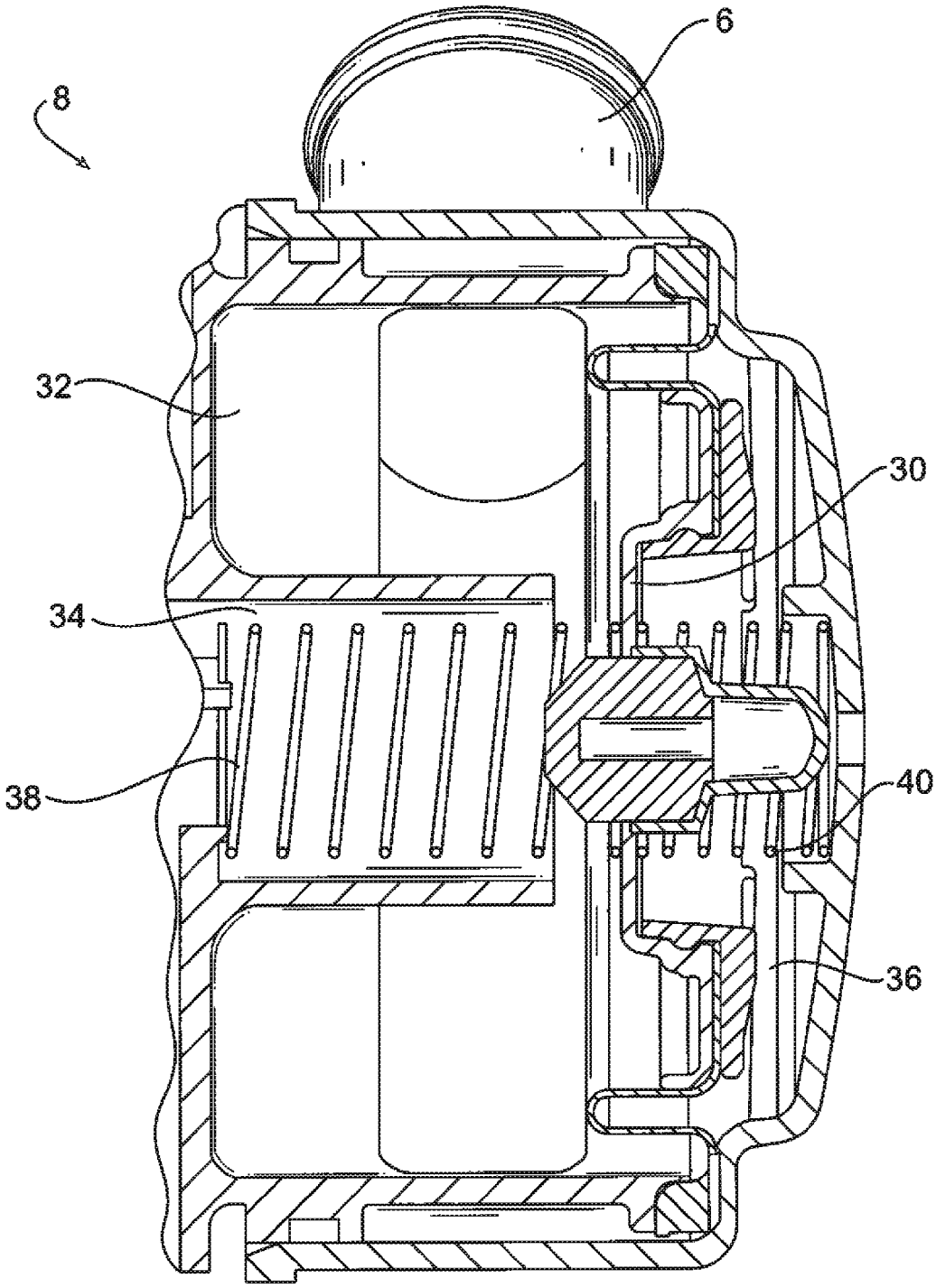
FIG. 3 illustrates a cross sectional view of a conventional regulator for use in a CCV system.
Figure 4:
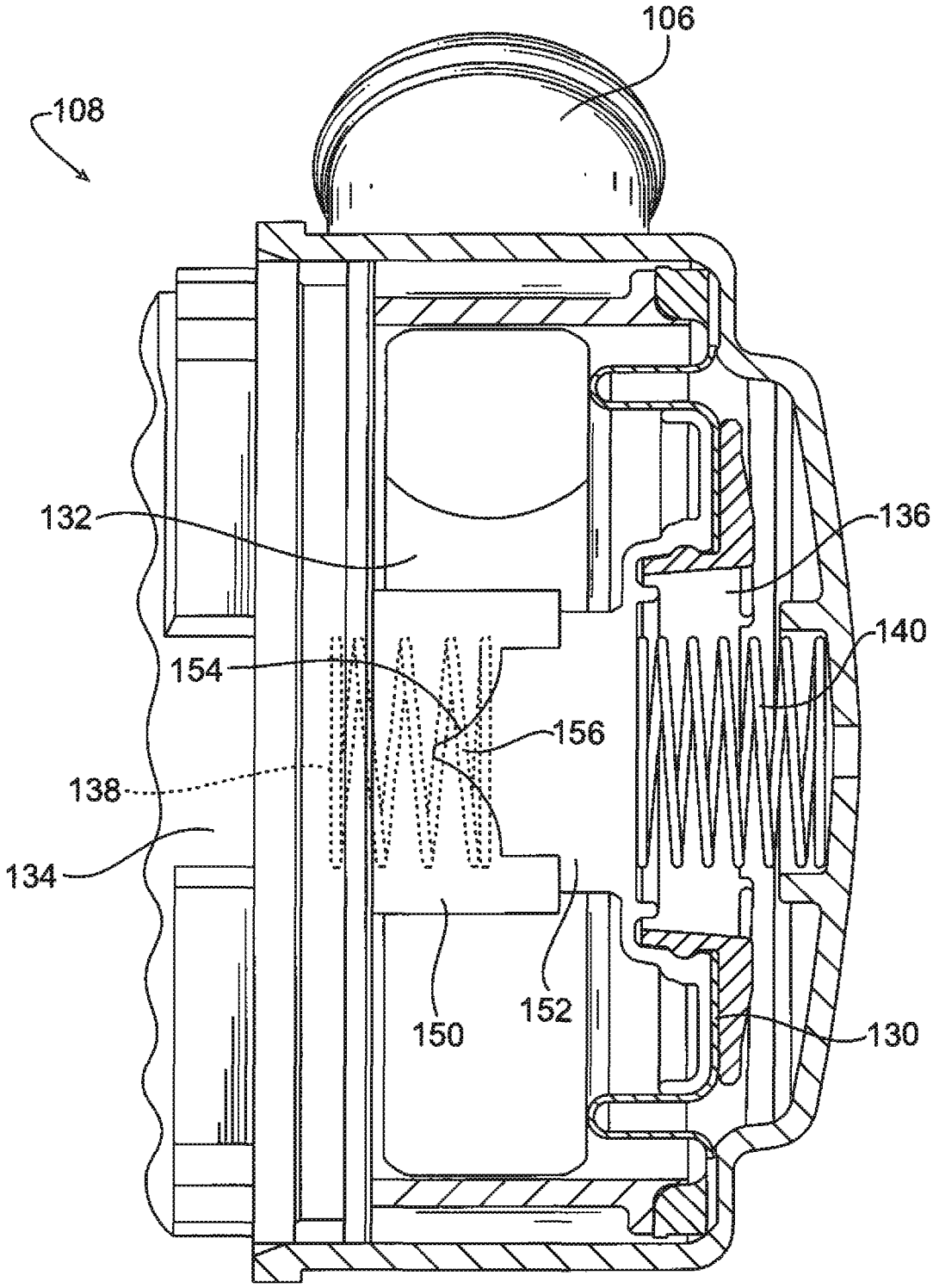
FIG. 4 illustrates a cross sectional view of a regulator in accordance with an embodiment of the present invention for use in a CCV system.

Referring to FIG. 4, a regulator 108 in accordance with an embodiment of the present invention is illustrated. The regulator 108 is in part similar in structure to the regulator 8 of FIG. 3 and so corresponding features are referred to by reference numbers that are incremented by 100.

The regulator 108 comprises a floating diaphragm 130 which is arranged to open or close to restrict blow-by gas flow and pressure as required to regulate the pressure within an engine crankcase. Blow-by gas enters a first regulator chamber 132 through the CCV gas inlet 106. The diaphragm 130 partially occludes the gap between the first chamber 132 and a second chamber 134 (in turn coupled to a CCV separator and pump). A first side of diaphragm 130 is exposed to the blow-by gas in chamber 132. A second side of the diaphragm 130 is exposed to an ambient pressure within a chamber 136 which has an opening to the ambient environment. In particular, the ambient environment may comprise a gas port extending to external of the engine, or the vehicle. More generally, the chamber 36 may be coupled to any other gas pressure reference. Movement of the diaphragm 130 is controlled by first and second springs 138, 140. Spring 138 is positioned within the second chamber and resists the diaphragm 130 moving to close the gap between the first and second chambers 132, 134. Spring 140 is positioned within the third chamber 136 and resists movement of the diaphragm 130 to open the gap between the first and second chambers 132, 134. Adjustment of the response of springs 138, 140 and adjustment of the relative sizes of the first and second sides of the diaphragm 130 acted upon by the blow-by gas and the ambient gas pressure can be used to control the rate and extent of movement of the diaphragm 130. The diaphragm 130 comprises an actuator arranged to control the flow of blow-by gas between the first and second chambers 132, 134.

The first and second chambers 132, 134 are separated by a tubular wall 150. The first side of diaphragm 130 is coupled to a tubular structure 152 arranged to slide within the tubular wall 150, and is coupled to the first spring 138. The interface between the tubular wall 150 and the tubular structure 152 may be arranged to substantially prevent blow-by gas from passing between the two, or a controlled amount of blow-by gas may be allowed to flow through the gap. Movement of the diaphragm 130 according to the pressure differential between the first chamber 132 and the third chamber 136 causes the tubular structure 152 to slide within tubular wall 150.

A slot 154 is cut into the tubular wall 150. The slot 154, in combination with the tubular structure 152 defines an open area 156 through which blow-by gas can flow between the first and second chambers 132, 134. The open area 156 forms an aperture between the first and second chambers 132, 134. The shape of the slot 154 is arranged to ensure that the open area 156 left open by the moving tubular structure 152 causes a pressure differential across the open area 156 which is appropriate for the flow-rate and vacuum characteristics generated by the pump. By controlling the shape of slot 154 a linear or non-linear relationship between any change in pump vacuum and the corresponding distance traveled by the diaphragm can be achieved. More specifically, the shape of the slot 154 can be chosen such that movement of the diaphragm 130 at a constant rate causes a non-linear response in the cross sectional area of the open area 156. Effectively any closed loop control function can be generated by the diaphragm 130 in response to a given input from the pump; more accurate crankcase pressure regulation can be achieved than for conventional regulators of the form illustrated in FIG. 3.

It can be seen that for the slot 154 of FIG. 4, as tubular structure 152 slides further into the tubular wall 154 (to the left in FIG. 4) the rate of reduction of open area 156 increases for a given displacement off the diaphragm 130. This is because the slot 154 tapers towards its closed end. Movement of diaphragm 130 may be limited to ensure that the open area 156 is never completely closed off.

It will be readily apparent to the appropriately skilled person that the shape of the slot 154 may vary significantly in order to achieve the desired closed loop control function. For instance, the slot may broaden towards its closed end, be of constant width or initially taper and terminate with an enlarged portion to prevent full closure of the open area 156. Furthermore, multiple slots of different sizes and shapes may be provided around the tubular wall.

In alternative embodiments of the invention one or more slots may be formed alternatively or additionally in the tubular structure coupled to the diaphragm. Furthermore, the tubular structure coupled to the diaphragm may be arranged to pass outside of the tubular wall separating the first and second chambers. In place of the tubular structure, a rolling portion of the diaphragm may be arranged to progressively cover and expose one or more slots in order to vary the size of the or each open area between the first and second chambers.

In alternative embodiments of the invention the first and second chambers may be separated by walls having alternative shapes, for instance a single planar wall extending between the two chambers and including a slot as described above. The actuator may comprise a sliding barrier coupled to the diaphragm arranged to partially occlude the slot.

More generally, the present invention is not limited to any one particular structure. Rather the scope of the appended claims should be considered to cover any regulator in which a first chamber and a second chamber are coupled together by one or more open areas. The size of the or each open area is arranged to be varied according to the position of a diaphragm or other moveable actuator which adjusts its position according to a pressure differential between gas in the first and/or second chambers and an external pressure reference.

Regulators according to the present invention have been primarily described herein in use as part of a CCV system. However, it will be readily apparent to the appropriately skilled person that they may be more widely applicable. More generally, such a regulator may be used in any application in which it is necessary to regulate a pressure drop for a fluid between a first chamber and a second chamber, with reference to an external pressure. Typically, the fluid will be a gas. Regulators according to the present invention are of particular benefit in pumped systems in order to obviate or mitigate the effects of pump surge and pressure hunting described above in the introductory portion of this description.

Further modifications to, and applications of, the present invention will be readily apparent to the appropriately skilled person from the teaching herein, without departing from the scope of the appended claims.

What is claimed is:

1. A regulator comprising:

a first chamber;

a second chamber separated from the first chamber by a wall including a slot between the chambers, the slot having a tapered, non-linear configuration within the wall, extending from a first, enlarged end in a portion of the wall toward the first chamber, to a narrow end in a portion of the wall toward the second chamber;

a housing containing the first and second chambers;

a diaphragm coupled to the housing and separating the first chamber from a pressure reference; and a sliding barrier coupled to the diaphragm and arranged to partially occlude the slot as the diaphragm moves, the slot and barrier defining an aperture between the chambers;

wherein the diaphragm is arranged to move in response to a change in the differential pressure across the diaphragm and to adjust the size of the aperture; and wherein the shape of the slot is chosen such that the rate of change of the cross sectional area of the aperture is arranged to have a non-linear response to a change in the pressure differential and in the response to the distance traveled by the diaphragm.

2. A regulator according to claim 1, wherein the first and second chambers are separated by a tubular wall and the barrier comprises a tubular structure coupled to the diaphragm and arranged to slide within or over the tubular wall to partially occlude the slot.

3. A regulator according to claim 1, wherein the first end of the slot opens to the first chamber, and the second end of the slot is closed.

4. A crankcase ventilation system comprising:

i.) a gas inlet which can receive gas from a crankcase;

ii.) a gas outlet which can be coupled to an engine air inlet system or discharge gases to the ambient atmosphere; and iii.) a regulator including a first chamber coupled to the gas inlet and a second chamber coupled to the gas outlet and separated from the first chamber by a wall including a slot between the chambers, the slot having a tapered, non-linear configuration within the wall, extending from a first enlarged end in a portion of the wall toward the first chamber, to a narrow end in a portion of the wall toward the second chamber;

a housing containing the first and second chambers;

a diaphragm coupled to the housing and separating the first chamber from a pressure reference;

a sliding barrier coupled to the diaphragm and arranged to partially occlude the slot as the diaphragm moves, the slot and barrier defining an aperture between the chambers;

wherein the diaphragm is arranged to move in response to a change in the differential pressure across the diaphragm and to adjust the size of the aperture;

wherein the shape of the slot is chosen such that the rate of change of the cross sectional area of the aperture is arranged to have a non-linear response to a change in the pressure differential and in response to the distance traveled by the diaphragm.

5. A crankcase ventilation system according to claim 4, further comprising a pump coupled between the regulator and the gas outlet and arranged to generate a vacuum thereby increasing the pressure differential across the regulator.

6. A crankcase ventilation system according to claim 4, wherein the first end of the slot opens to the first chamber, and the second end of the slot is closed.

7. A crankcase ventilation system comprising:

i.) a gas inlet which can receive gas from a crankcase;

ii.) a gas outlet which can be coupled to an engine air inlet system or discharge gases to the ambient atmosphere; and iii) a regulator including a first chamber coupled to the gas inlet and a second chamber coupled to the gas outlet, and separated from the first chamber by a wall including a slot between the chambers, the slot having a tapered, non-linear configuration within the wall extending from a first enlarged end in a portion of the wall toward the first chamber, to a narrow end in a portion of the wall toward the second chamber;

a housing containing the first and second chambers;

a diaphragm coupled to the housing and separating the first chamber from a pressure reference; and a sliding barrier coupled to the diaphragm and arranged to partially occlude the slot as the diaphragm moves, the slot and barrier defining an aperture between the chambers;

wherein the diaphragm is arranged to move in response to a change in the differential pressure across the diaphragm and to adjust the size of the aperture; and wherein the geometry of the slot and barrier are chosen such that the rate of change of the cross sectional area is arranged to have a non-linear response to a change in the pressure differential and in response to the distance traveled by the diaphragm.

8. A crankcase ventilation system according to claim 7, wherein the first and second chambers are separated by a tubular wall, and the slot is provided in the tubular wall, and the barrier comprises a tubular structure coupled to the diaphragm and arranged to slide within or over the tubular wall to partially occlude the slot.

9. A crankcase ventilation system according to claim 7, wherein the first end of the slot opens to the first chamber, and the second end of the slot is closed.

10. A regulator comprising:

a first chamber;

a second chamber separated from the first chamber by a wall including a slot between the chambers;

a housing containing the first and second chambers;

a diaphragm coupled to the housing and separating the first chamber from a pressure reference; and a sliding barrier coupled to the diaphragm and arranged to move along the wall and across the slot to partially occlude the slot as the diaphragm moves, the slot and barrier defining an aperture between the chambers;

wherein the diaphragm is arranged to move in response to a change in the differential pressure across the diaphragm and to adjust the size of the aperture; and wherein the shape of the slot is chosen such that the rate of change of the cross sectional area of the aperture is arranged to have a non-linear response to a change in the pressure differential and in the response to the distance traveled by the diaphragm.

11. A regulator according to claim 10, wherein the first end of the slot opens to the first chamber, and the second end of the slot is closed.

12. A crankcase ventilation system comprising:

i.) a gas inlet which can receive gas from a crankcase;

ii.) a gas outlet which can be coupled to an engine air inlet system or discharge gases to the ambient atmosphere; and iii.) a regulator, the regulator including a first chamber coupled to the gas inlet and a second chamber coupled to the gas outlet and separated from the first chamber by a wall including a slot between the chambers;

a housing containing the first and second chambers;

a diaphragm coupled to the housing and separating the first chamber from a pressure reference;

a sliding barrier coupled to the diaphragm and arranged to move along the wall and across the slot to partially occlude the slot as the diaphragm moves, the slot and barrier defining an aperture between the chambers;

wherein the diaphragm is arranged to move in response to a change in the differential pressure across the diaphragm and to adjust the size of the aperture;

wherein the shape of the slot is chosen such that the rate of change of the cross sectional area of the aperture is arranged to have a non-linear response to a change in the pressure differential and in response to the distance traveled by the diaphragm.

13. A crankcase ventilation system according to claim 12, wherein the first end of the slot opens to the first chamber, and the second end of the slot is closed.

14. A crankcase ventilation system comprising:

i.) a gas inlet which can receive gas from a crankcase;

ii.) a gas outlet which can be coupled to an engine air inlet system or discharge gases to the ambient atmosphere; and iii.) a regulator, the regulator including a first chamber coupled to the gas inlet and a second chamber coupled to the gas outlet, and separated from the first chamber by a wall including a slot between the chambers;

a housing containing the first and second chambers;

a diaphragm coupled to the housing and separating the first chamber from a pressure reference; and a sliding barrier coupled to the diaphragm and arranged to move along the wall and across the slot to partially occlude the slot as the diaphragm moves, the slot and barrier defining an aperture between the chambers;

wherein the diaphragm is arranged to move in response to a change in the differential pressure across the diaphragm and to adjust the size of the aperture; and wherein the geometry of the slot and barrier are chosen such that the rate of change of the cross sectional area is arranged to have a non-linear response to a change in the pressure differential and in response to the distance traveled by the diaphragm, wherein the first chamber is coupled to the gas inlet.

15. A crankcase ventilation system according to claim 14, wherein the first end of the slot opens to the first chamber, and the second end of the slot is closed.

* * * * *